US006271489B1

(12) United States Patent
Engel et al.

(10) Patent No.: US 6,271,489 B1
(45) Date of Patent: Aug. 7, 2001

(54) CAM-LOCK ENHANCED PRESSURE SWITCH CONTACTS

(75) Inventors: Edward I. Engel, Hamilton; Larry Gene Ratliff, Middletown, both of OH (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/477,915

(22) Filed: Dec. 31, 1999

(51) Int. Cl.[7] ..... H01H 1/50; H01H 21/54
(52) U.S. Cl. ..... 200/256; 200/255; 200/554
(58) Field of Search ..... 200/15, 48 KB, 200/252, 254, 255, 256, 258–261, 554, 555, 556

(56) References Cited

U.S. PATENT DOCUMENTS

| | | | | |
|---|---|---|---|---|
| Re. 31,634 | | 7/1984 | Norby . | |
| 2,090,474 | * | 8/1937 | Crabbs et al. | 200/254 X |
| 2,347,030 | * | 4/1944 | Crabbs | 200/256 X |
| 2,546,366 | * | 3/1951 | Lindae | 200/255 X |
| 3,180,963 | * | 4/1965 | Hales et al. | 200/256 |
| 3,593,235 | | 7/1971 | Nicol . | |
| 3,604,300 | | 9/1971 | Allison . | |
| 3,614,362 | | 10/1971 | Keranen . | |
| 3,624,333 | | 11/1971 | Schurr . | |
| 3,632,936 | | 1/1972 | Piber . | |
| 3,636,286 | | 1/1972 | Hults . | |
| 3,644,793 | | 2/1972 | Ilk . | |
| 3,646,355 | | 2/1972 | Ireland et al. . | |
| 3,680,016 | | 7/1972 | Becker et al. . | |
| 3,711,669 | | 1/1973 | Keranen . | |
| 3,720,797 | | 3/1973 | Gunn et al. . | |
| 3,726,494 | | 4/1973 | Flagg et al. . | |
| 3,740,741 | | 6/1973 | Jones . | |
| 3,742,402 | | 6/1973 | Nicol et al. . | |
| 3,742,403 | | 6/1973 | Nicol . | |
| 3,787,654 | | 1/1974 | Rys . | |
| 3,805,115 | | 4/1974 | Heckelman . | |
| 3,809,840 | | 5/1974 | Schurr . | |
| 3,838,355 | | 9/1974 | Papaieck . | |
| 3,875,360 | | 4/1975 | Rys . | |
| 3,876,847 | | 4/1975 | Dykes et al. . | |
| 3,879,589 | | 4/1975 | Rys . | |
| 3,881,077 | | 4/1975 | Piber . | |
| 3,891,862 | | 6/1975 | Clark . | |
| 3,895,198 | | 7/1975 | Piber . | |
| 3,919,513 | * | 11/1975 | Phillips | 200/256 |
| 3,967,132 | | 6/1976 | Takamine . | |
| 4,001,683 | | 1/1977 | McNeilly . | |
| 4,002,874 | | 1/1977 | Brown . | |
| 4,041,260 | | 8/1977 | Swindler et al. . | |

(List continued on next page.)

OTHER PUBLICATIONS

Eaton Catalog, Oct 1998, Cutler–Hammer—G–14 Safety Switches Heavy Duty Double Throw, Fusible, Non–Fusible; Discount Symbol 22CD; Cat. 73.01.T.E.

*Primary Examiner*—J. R. Scott
(74) *Attorney, Agent, or Firm*—David R. Stacey; Larry T. Shrout; Larry I. Golden

(57) ABSTRACT

A pressure switch device and method of forming the device is disclosed. The switch has a hinge terminal having a fixed end of a blade apparatus pivotally attached thereto, a jaw terminal adapted to receive a free end of the blade apparatus at a receiving portion, the blade apparatus having two blades fastened together and a spacer between the blades. Pairs of cams at either end of the blades rotate to engage protrusions in order to create a pressure lock. The pressure is enhanced by a spring washer. A connecting link attached one of each pair of cams, a drive link attached to the blades and connecting link, and a drive shaft cooperate to open and close the switch such that the switch may be first placed in a closed position, and then locked by further rotation of the drive shaft as the cam protrusions engage. The drive shaft is spring loaded to create torsional force which must be overcome to rotate the drive shaft in either direction.

20 Claims, 9 Drawing Sheets

U.S. PATENT DOCUMENTS

| | | |
|---|---|---|
| 4,110,585 | 8/1978 | Brown . |
| 4,121,065 | 10/1978 | Woodard . |
| 4,121,069 | 10/1978 | Long . |
| 4,154,997 | 5/1979 | Grebner et al. . |
| 4,166,935 | 9/1979 | Norby . |
| 4,177,389 | 12/1979 | Schott . |
| 4,218,602 | 8/1980 | Creech . |
| 4,267,711 | 5/1981 | Kolze . |
| 4,335,287 | 6/1982 | Achenbach et al. . |
| 4,337,450 | 6/1982 | Matthies . |
| 4,370,528 | 1/1983 | Aschenbach . |
| 4,454,398 | 6/1984 | Aschenbach et al. . |
| 4,490,694 | 12/1984 | Godbout . |
| 4,517,717 | 5/1985 | Gentry . |
| 4,525,697 | 6/1985 | Jones et al. . |
| 4,544,810 | 10/1985 | Butterworth . |
| 4,559,971 | 12/1985 | Bradshaw . |
| 4,736,081 | 4/1988 | Sorrells . |
| 4,788,618 | 11/1988 | Kimura . |
| 4,791,255 | 12/1988 | Eliezer . |
| 4,866,221 | 9/1989 | Obermann et al. . |
| 4,908,553 | 3/1990 | Hoppie et al. . |
| 4,934,492 | 6/1990 | Hayes-Sheen . |
| 5,005,382 | 4/1991 | Duve . |
| 5,045,648 | 9/1991 | Fogleman, Sr. . |
| 5,052,424 | 10/1991 | Zerndt et al. . |
| 5,117,189 | 5/1992 | Terminiello et al. . |
| 5,149,998 | 9/1992 | Wolcott . |
| 5,157,383 | 10/1992 | Fisher . |
| 5,216,396 | 6/1993 | Stahly . |
| 5,262,679 | 11/1993 | Schweitzer, III et al. . |
| 5,308,957 | 5/1994 | Huffington . |
| 5,355,024 | 10/1994 | Elliott et al. . |
| 5,397,868 | 3/1995 | Smith et al. . |
| 5,436,415 | 7/1995 | Smith et al. . |
| 5,486,978 | 1/1996 | Fishovitz . |
| 5,542,513 | 8/1996 | Reyes . |
| 5,612,580 | 3/1997 | Janonis et al. . |
| 5,642,002 | 6/1997 | Mckanik et al. . |
| 5,735,179 | 4/1998 | Edwards, Jr. et al. . |
| 5,739,488 | 4/1998 | Cassity et al. . |
| 5,777,283 | 7/1998 | Greer . |

* cited by examiner

CAM-LOCK ENHANCED PRESSURE SWITCH CONTACTS

TECHNICAL FIELD

The present invention relates generally to pressure switch contacts, and more specifically, to pressure switch devices having a cam locking mechanism to apply pressure at the contact points.

BACKGROUND OF THE INVENTION

There are numerous conventional pressure switches which utilize bolts and latches for applying pressure, or spring pressure configurations. Such conventional switches require adjustments in order to provide the desired amount of pressure at the contacts. Another disadvantage of conventional switches is the failure to provide a low pressure state before the switch is opened, or before the switch is closed, such that the pressure at the contact causes wear and stiffness during operation.

Conventional pressure switches often form unreliable electrical connections at the contacts when spring contacts are used. Furthermore, problems with contact sticking occur at elevated temperatures. Current induced thermal expansion of copper blades and terminals increases contact pressure in high rate spring pressure designs and may prevent the switch from opening if not carefully adjusted.

A further drawback of conventional switches is poor resistance to contact welding on fault closings.

Therefore, a reliable pressure switch which overcomes the above problems would be of great advantage in the electrical pressure switch industry.

SUMMARY OF THE INVENTION

In view of the above listed problems of the prior art, it is an object of the present invention to provide a pressure switch which does not require adjustment in order to provide the desired pressure.

It is another object of the present invention to provide a pressure switch device which provides a low-pressure state to facilitate opening and closing without excessive wear, yet maintains a reliable electrical connection.

It is a further object of the present invention to provide a pressure switch device which is easily opened and closed under high temperature conditions, and is more resistant to contact welding on fault closings.

In view of the above, and other advantages, a novel pressure switch is provided with a cam locking assembly. The switch has a jaw terminal and a hinge terminal. A blade assembly is pivotally mounted to the hinge terminal, and may rotate to engage the jaw terminal at a receiving portion.

The blade assembly preferably comprises two blades which straddle the terminal. The two blades are fastened to one another at either end via a fastener. The fastener preferably comprises a threaded bolt and a nut. A spacer is placed between the blades on each fastener to hold them in spaced relation, preferably slightly closer together than the distance across the terminals when in the open position.

A pair of cams is mounted at either end of the blade assembly. One cam of each pair may be fixedly mounted to the blade assembly. The cams may be mounted via the same fasteners holding the blades together. The other two of the pairs of cams are rotatably mounted. They are fastened to a rigid connecting link. Thus, movement of the connecting link will rotate the cams.

The cams are provided with protrusions, or raised portions, between one another such that when they are rotated into a locked position, they are forced apart, and increased pressure is applied forcing the blades closer together to engage the terminals. A spring washer is preferably mounted on each fastener to enhance the pressure. The spring washer flattens as the cams are rotated into the locked position.

A drive link is pivotally mounted to the blade assembly, and pivotally mounted to the connecting link. The drive link is preferably an insulating drive link. A drive shaft is mounted to the free end of the drive link via a crank pin. The drive shaft has a free end which is in fixed relation to the terminals, such as by affixing it to further mechanisms which enable its stability and rotation about a point near the free end.

As the drive link is rotated, the blade assembly moves from an open position to a closed position. Thus, the blade assembly is able to contact the receiving portion of the jaw terminal prior to the cams engaging. Further rotation of the drive shaft rotates the cams into engagement such that they are in a locked position and form a pressure engagement of the blades onto the terminals. In the locked position, the drive shaft forms a 180° angle with the drive link, placing them in toggle and creating a rigid structure to hold the switch securely in a closed position. The structure is preferably configured such that the rotation of the cam plates is greatest when the motion of the blades is least at the end of the rotation of the drive shaft into the closed and locked position. Thus, the need for a latch to coordinate the blade position with the contact pressure clamping action is eliminated. The pressure between the blades is increased slightly before the blades are in a fully closed position, and are fully pressured at the point where the blades are in a completely closed position, allowing a high pressure wiping action which creates a cleaner contact surface. However, the pressure is released before substantial movement of the blades during opening, allowing opening to occur without increased force, and decreasing mechanical wear. The rise and dwell shape of the cams allows over travel after reaching full contact pressure, and thus eliminates the need for position adjustment. Also, the fixed rise of the cams allows for adjusting the tie bolts by tightening them solid with the cams unlocked, then backing off a specific amount, such as a sixth of a turn, eliminating the need to tighten by feel as with conventional switches.

Torsional springs are preferably provided at the drive shaft such that resistance is encountered when the drive shaft is rotated in either direction. Stops are provided to prevent rotation of the drive shaft past the fully open or fully locked positions.

By forming the switch in a fashion such that the blades can engage and disengage the terminals without pressure applied, yet allowing the cams to provide pressure gradually with engagement eliminates numerous problems.

The cams may be stamped plates. The pressure switch device has applications in circuit interrupters, disconnect devices, and numerous other applications.

Other features and advantages of the invention will be apparent from the following specification taken in conjunction with the following drawings.

DETAILED DESCRIPTION OF THE PREFERRED EMBODIMENT

Figure 1:
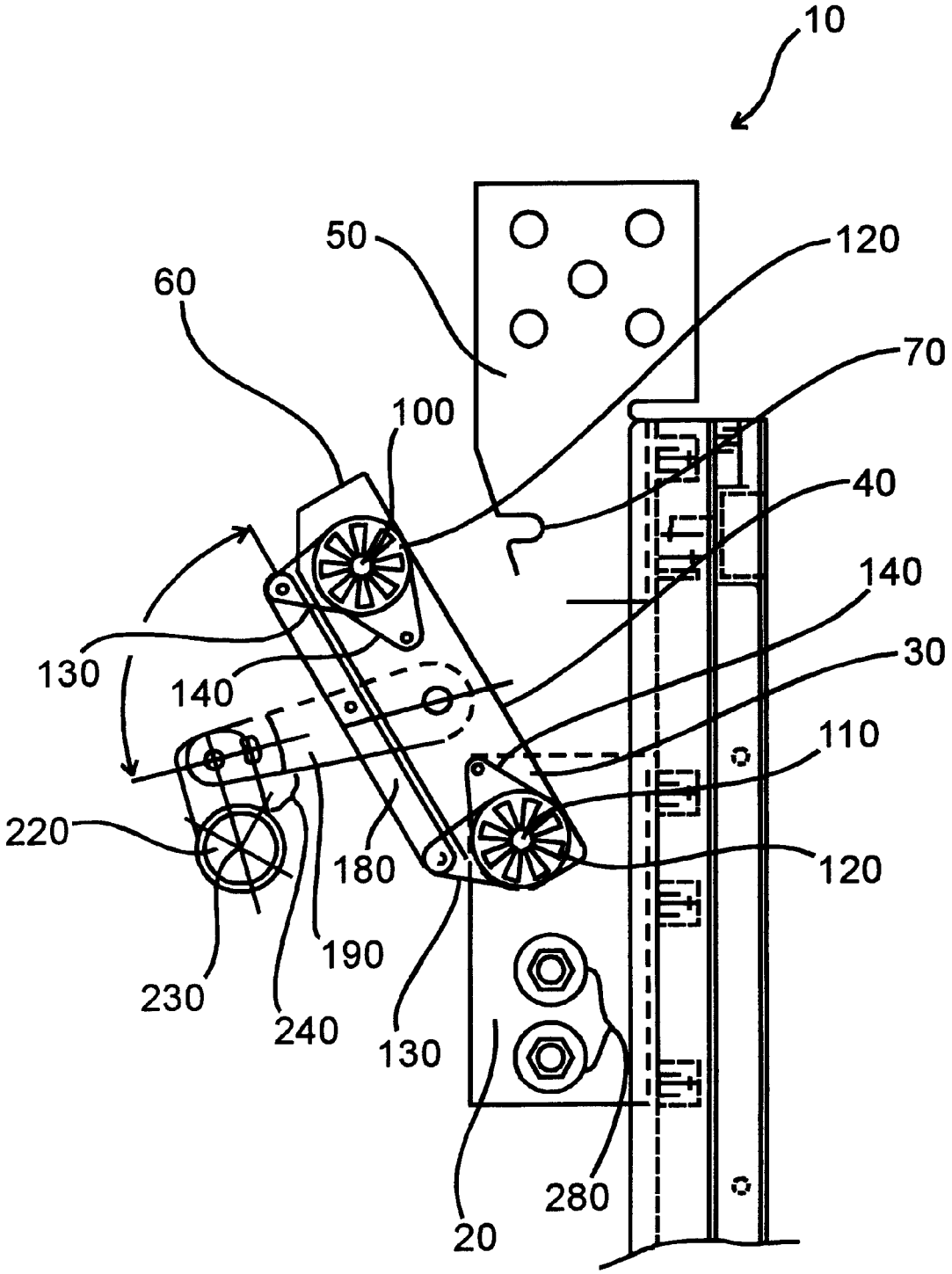
FIG. 1 is a side view of the pressure switch device of the present invention in an open position.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the figures, the pressure switch device 10 comprises a hinge terminal 20 having a fixed end 30 of a blade apparatus 40 pivotally attached thereto. Terminals for the blade apparatus to contact include a jaw terminal 50 adapted to receive a free end 60 of said blade apparatus 40 at a receiving portion 70.

The blade apparatus 40 has a first blade 80 and a second blade 90 for straddling the hinge terminal 20 and the jaw terminal 50. The first blade 80 and the second blade 90 are fastened together via a first fastener 100 at opposing free ends 60 of the blades and via a second fastener 110 at opposing fixed ends 30 of the blades. The fasteners 100, 110 are preferably threaded bolts secured by nuts.

A first pair of cams 120 is attached to the free end 30 of the blade apparatus 40. A first cam 130 of the first pair of cams 120 is rotatably mounted with respect to a second cam 140. The cams 120 have protrusions, or raised portions 150 between one another, wherein the first cam 130 is selectively rotatable between a first open position 160 and a second locked position 170 in which the protrusions 150 engage to apply increased pressure between the blades 80 and 90, and wherein the second cam 140 is fixedly mounted to the blade apparatus 40.

Similarly, a second pair of cams 120 is attached to the fixed end 30 of the blade apparatus 40. A first cam 130 of the second pair of cams 120 is rotatably mounted with respect to a second cam 140. The cams also have protrusions 150 between one another, wherein the first cam 130 is selectively rotatable between a first open position 160 and a second locked position 17 in which the protrusions 150 engage to apply increased pressure between the blades 80 and 90, and wherein the second cam 140 is fixedly mounted to the blade apparatus 40.

A connecting link 180 is preferably attached at a distal end and a proximal end to the first cams 130 of the pairs of cams 120. The connecting link 180 is movable between a first open position 160 in which both of the pairs of cams 120 are in the open position 160 and a second locked position 170 in which both of the pairs of cams 120 are in the locked position 170.

Figure 2:
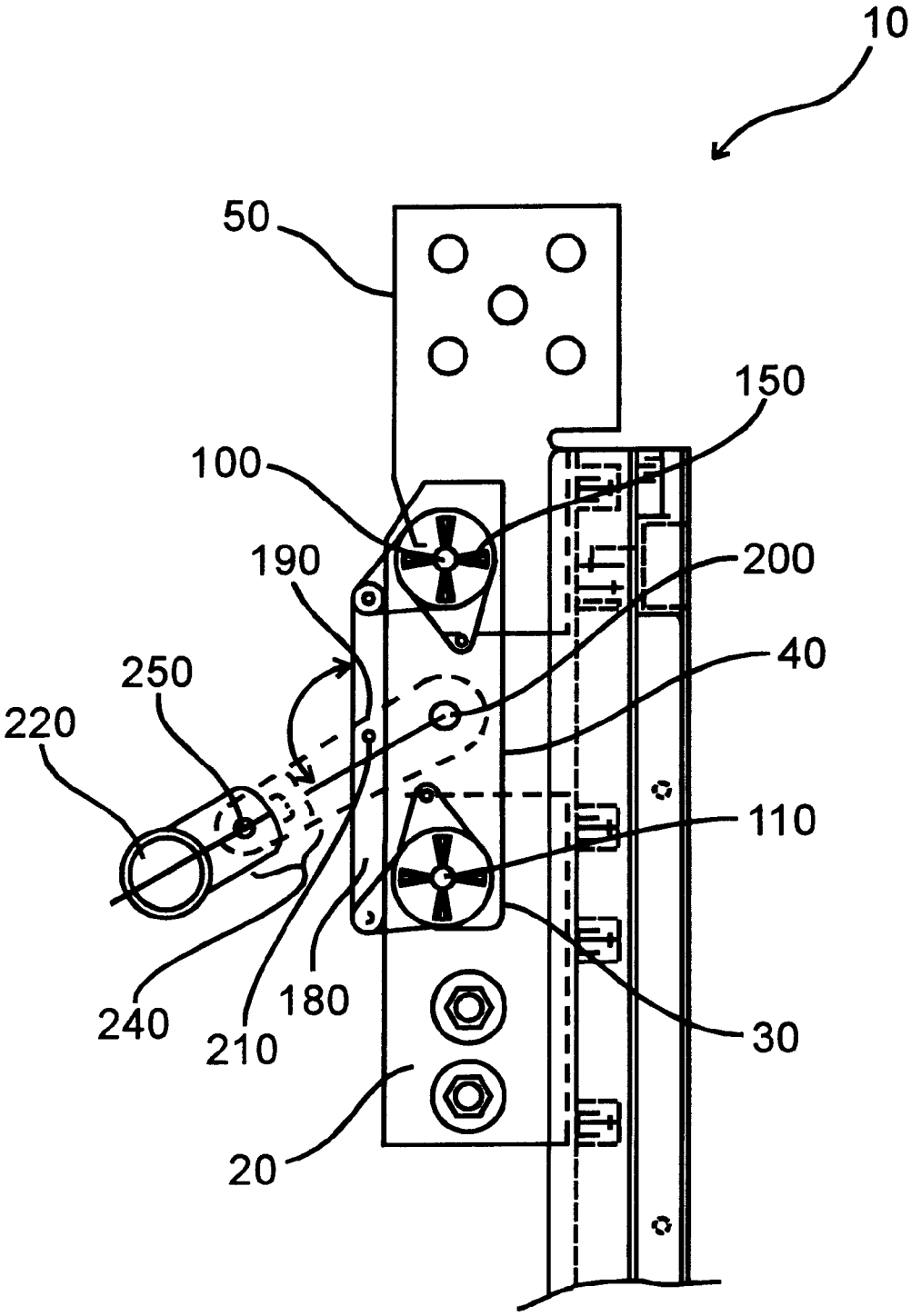
FIG. 2 is a side view of the pressure switch device of the present invention in a closed and locked position.
Figure 3:
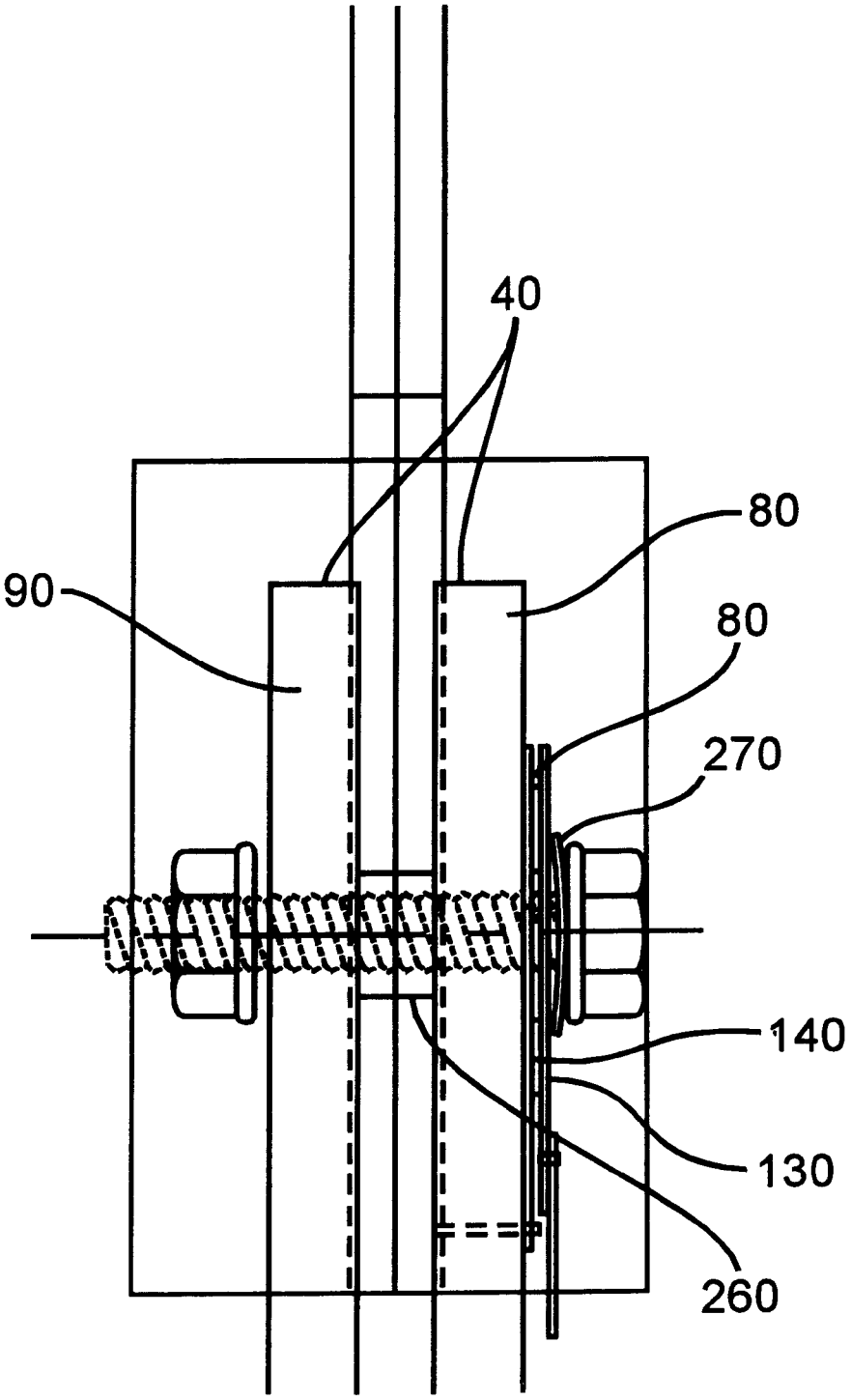
FIG. 3 is a sectional view of the cam and blade assembly of the present invention in an open position.
Figure 4:
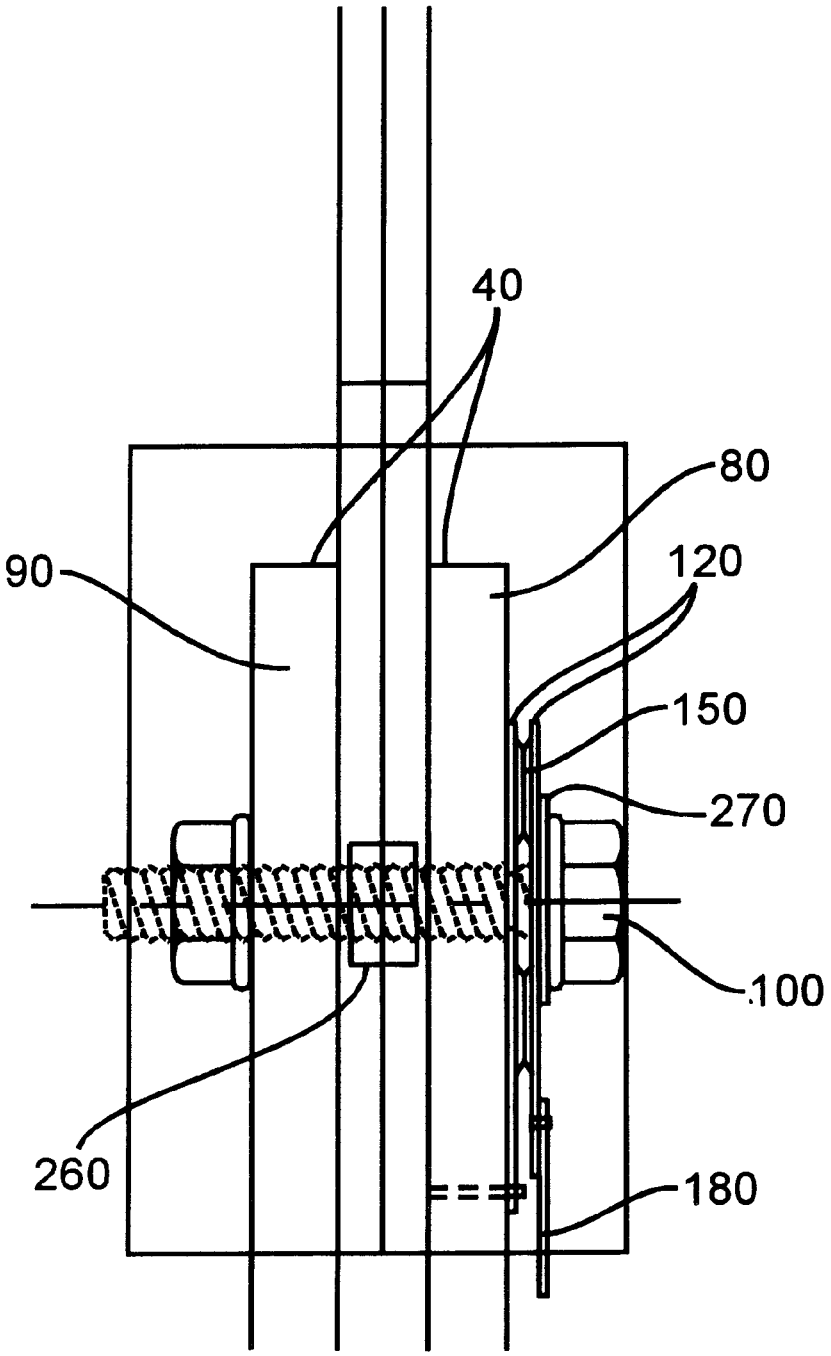
FIG. 4 is a sectional view of the cam and blade assembly of the present invention in a locked position.
Figure 5:
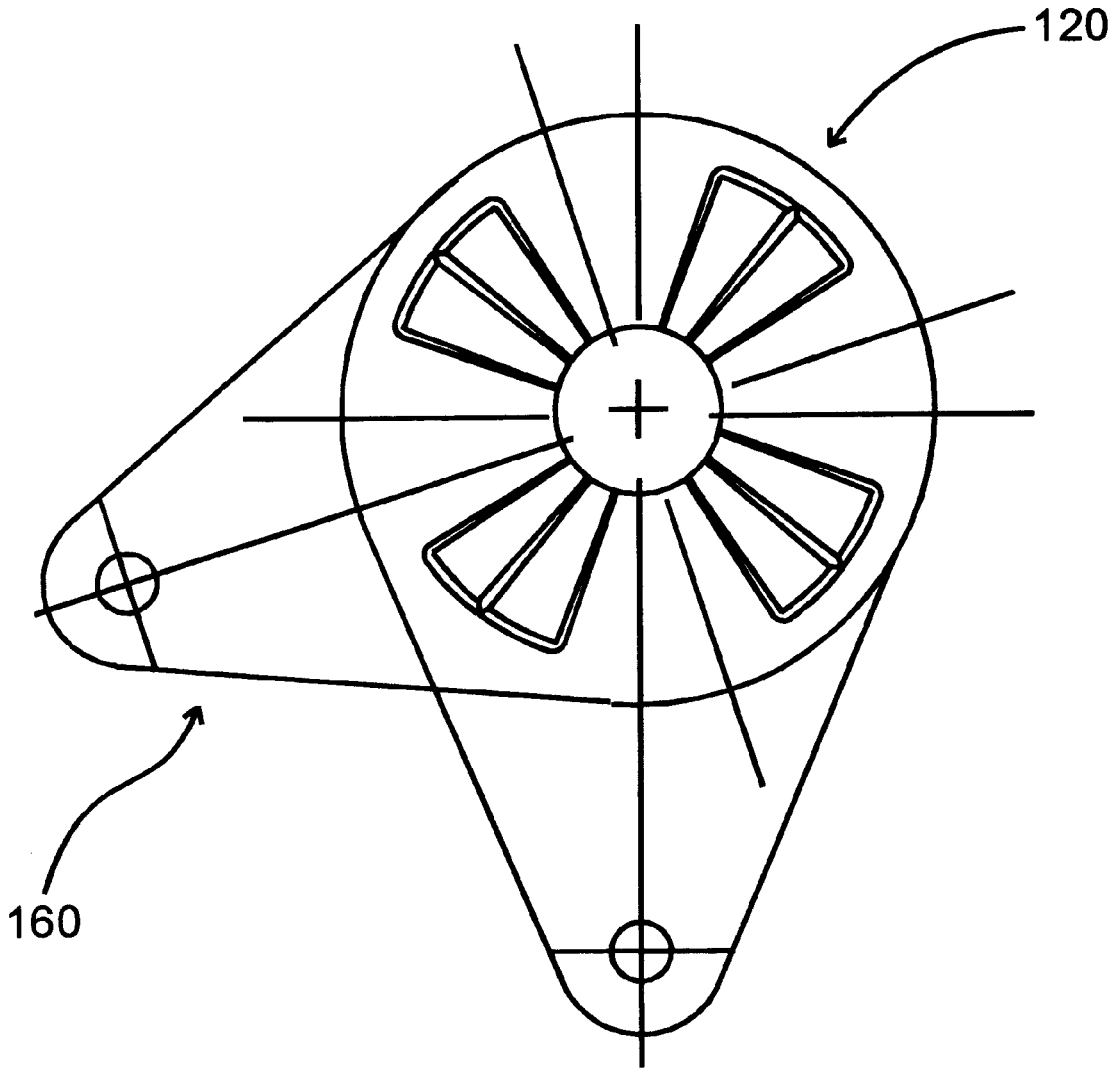
FIG. 5 is an elevated view of the cam assembly of the present invention in a position 10° before closed position.
Figure 6:
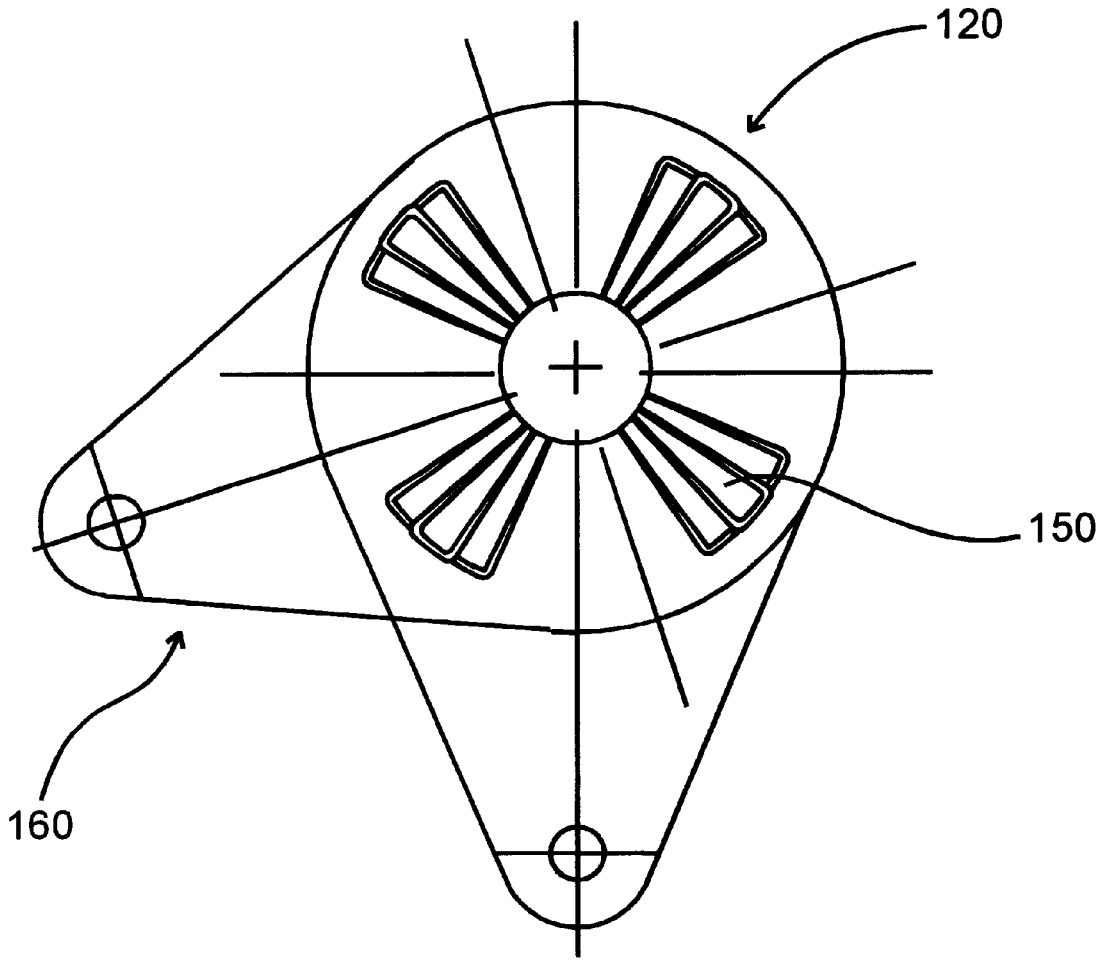
FIG. 6 is an elevated view of the cam assembly of the present invention in a closed position.

A drive link 190 is pivotally mounted at a first end 200 to the blade apparatus 40, and pivotally mounted at an interior point 210 to the connecting link 180. The drive link 190 is preferably an insulating drive link, and is selectively movable between a first open position in which the switch 10 is open as in FIG. 1, a second closed position in which the blade apparatus 40 is caused to engage the receiving portion 70 of the jaw terminal 50 while the cams 120 remain in the open position 160, and a third locked position as in FIG. 2, in which the connecting link 180 is caused to move to its locked position, thereby engaging the protrusions 150 of the cams 120.

A drive shaft 220 is pivotally mounted to a second end of the drive link 190. Rotation of the drive shaft 220 facilitates movement of the drive link 190 between its first, second, and third positions, wherein the drive shaft has a free end 230 which is fixed relative to the hinge terminal 20 such that said rotation of the drive shaft 220 forces the drive link 190 to move between the positions forming a shaft link angle 240 between the drive shaft 220 and the drive link 190 at a first angle less than 180° when the drive link 190 is in the first position, a second angle greater than the first angle and less than 180° when the drive link 190 is in the second position, and a third angle substantially equal to 180° when the drive link 190 is in the third position. The drive shaft 220 is spring loaded at a point of connection with the drive link 190, and torsional force must be overcome in order to rotate the drive shaft 220 in either direction. The connection between the drive shaft 220 and the drive link 190 is preferably a crank pin 250.

The blade apparatus 40 preferably includes spacers 260 placed along the fasteners 100 and 110 to maintain the parallel blades 80 and 90 in spaced relation. In order to facilitate consistent pressure, spring washers 270 are placed on fasteners 100 and 110 such that they may flatten or deform when the cams 120 are engaged.

Figure 7:
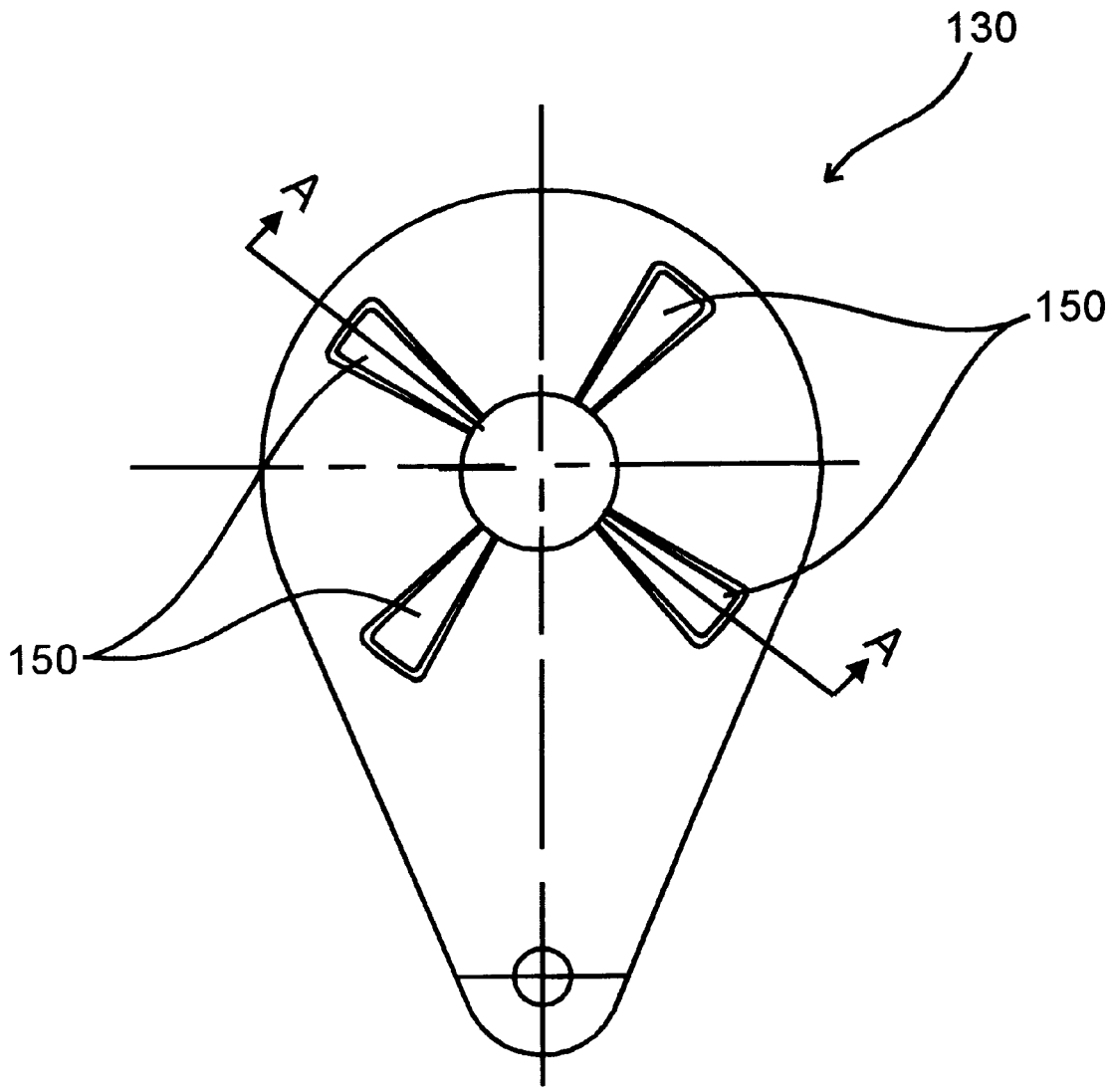
FIG. 7 is an elevated view of a single cam of the present invention.
Figure 8:
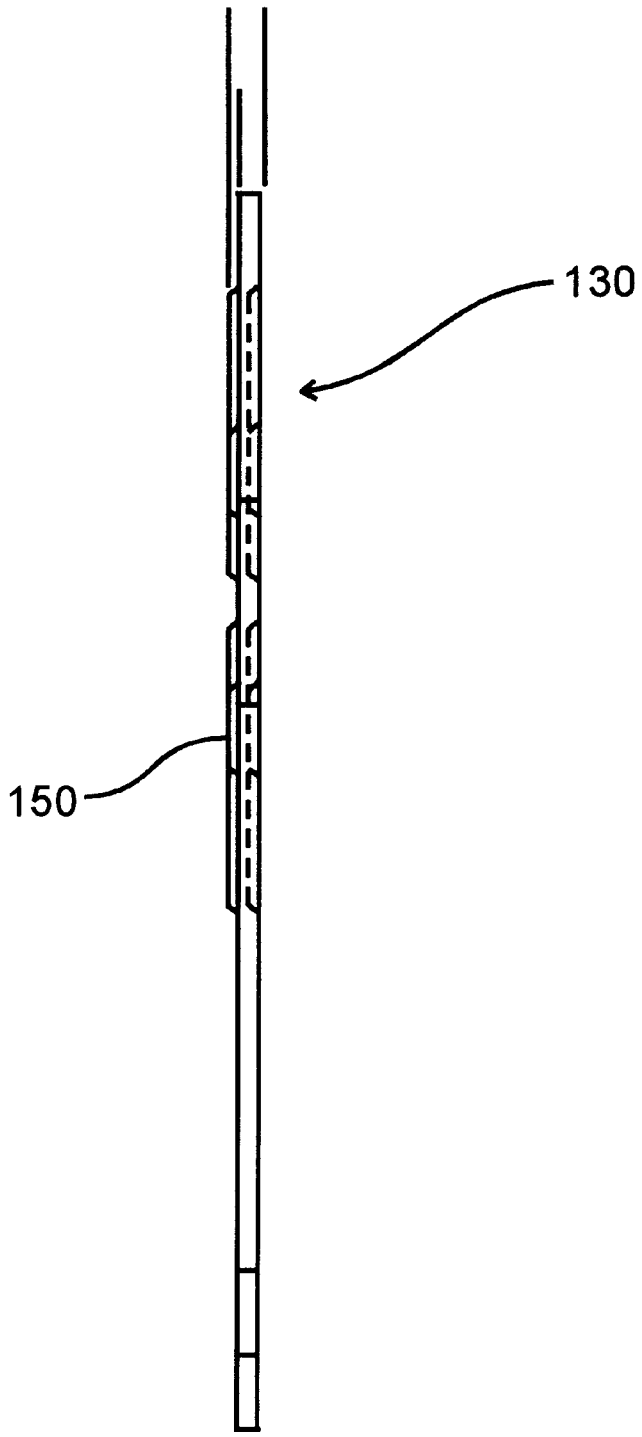
FIG. 8 is a side view of a single cam of the present invention.
Figure 9:
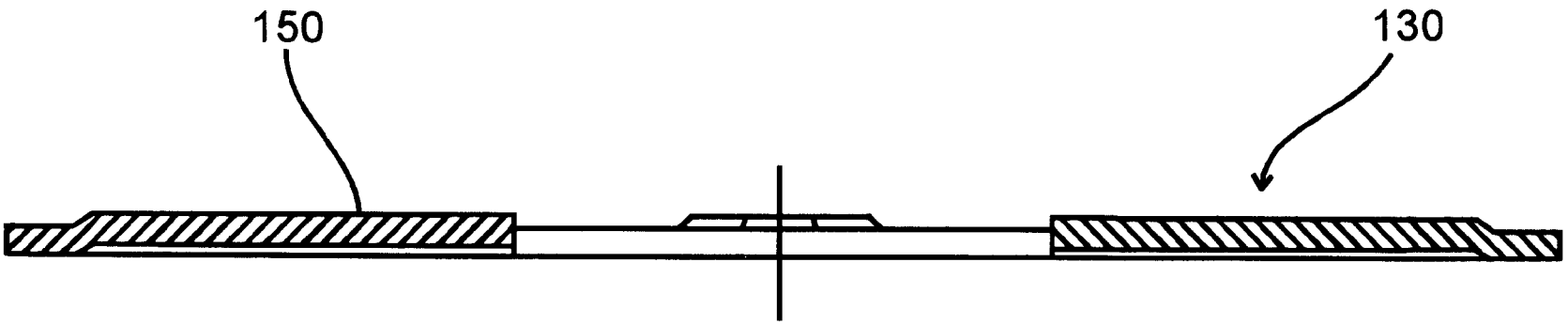
FIG. 9 is a sectional view of a single cam of the present invention.

For various electrical applications, a fuse 280 may be mounted on the switch on either terminal, preferably on hinge terminal 20. The preferred specifications for the cams are shown in FIGS. 7–9, although various configurations will be apparent to those in the industry.

A method of forming switch 10 is also understood from the foregoing detailed description by providing the various components described.

While the specific embodiments have been illustrated and described, numerous modifications come to mind without significantly departing from the spirit of the invention, and the scope of protection is only limited by the scope of the accompanying claims.

What is claimed is:

1. A pressure switch device comprising:

a hinge terminal having a fixed end of a blade apparatus pivotally attached thereto, a jaw terminal adapted to receive a free end of said blade apparatus, said blade apparatus having a first blade and a second blade for straddling said hinge terminal and said jaw terminal, wherein said first blade and said second blade are fastened together via a first fastener at opposing free ends of said blades and via a second fastener at opposing fixed ends of said blades, and a first pair of cams attached to the free end of said blade apparatus, wherein a first one of said first pair of cams is rotatably mounted with respect to a second one of said cams, said cams having protrusions between one another, wherein the first cam is selectively rotatable between a first open position and a second locked position in which the protrusions engage to apply increased pressure between the blades.

2. The pressure switch device according to claim 1, further comprising a second pair of cams attached to the fixed end of said blade apparatus, wherein a first one of said second pair of cams is rotatably mounted with respect to a second one of said cams, said second pair of cams having protrusions between one another, wherein the first cam is selectively rotatable between a first open position and a second locked position in which the protrusions engage to apply increased pressure between the blades.

3. The pressure switch device according to claim 2, further comprising a connecting link attached at a distal end to the first cam of said first pair of cams, and attached at a proximal end to the first cam of said second pair of cams, wherein the connecting link is movable between a first open position in which both of said pairs of cams are in said open position and a second locked position in which both of said pairs of cams are in said locked position.

4. The pressure switch device according to claim 3, further comprising a drive link pivotally mounted at a first end to the blade apparatus and pivotally mounted at an interior point to the connecting link, wherein the drive link is selectively movable between a first open position in which the switch is open, a second closed position in which the blade apparatus is caused to engage a receiving portion of the jaw terminal while the cams remain in said open position, and a third locked position in which the connecting link is caused to move to its said locked position.

5. The pressure switch device according to claim 4, further comprising a drive shaft pivotally mounted to a second end of said drive link, wherein rotation of said drive shaft facilitates movement of the drive link between its said first, second, and third positions.

6. The pressure switch device according to claim 5, wherein the drive shaft has a free end which is fixed relative to the hinge terminal such that said rotation of the drive shaft forces the drive link to move between said positions.

7. The pressure switch device according to claim 6, wherein the drive shaft is spring loaded at a point of connection with the drive link, and wherein torsional force must be overcome in order to rotate the drive shaft in either direction.

8. The pressure switch device according to claim 7, wherein a shaft link angle formed between the drive shaft and the drive link is at a first angle less than 180° when the drive link is in said first position, a second angle greater than the first angle and less than 180° when the drive link is in said second position, and a third angle substantially equal to 180° when the drive link is in said third position.

9. The pressure switch device according to claim 3, wherein spacers are mounted along a shaft of said fasteners between said blades.

10. The pressure switch device according to claim 9, wherein spring washers are mounted on the shafts of said fasteners for providing further pressure between said blades.

11. The pressure switch device according to claim 3, wherein said fasteners are threaded bolts having a nut fastened to their free end.

12. A pressure switch device comprising:

a hinge terminal having a fixed end of a blade apparatus pivotally attached thereto, a jaw terminal adapted to receive a free end of said blade apparatus at a receiving portion, said blade apparatus having a first blade and a second blade for straddling said hinge terminal and said jaw terminal, wherein said first blade and said second blade are fastened together via a first fastener at opposing free ends of said blades and via a second fastener at opposing fixed ends of said blades, a first pair of cams attached to the free end of said blade apparatus, wherein a first one of said first pair of cams is rotatably mounted with respect to a second one of said cams, said cams having protrusions between one another, wherein the first cam is selectively rotatable between a first open position and a second locked position in which the protrusions engage to apply increased pressure between the blades, and wherein the second cam is fixedly mounted to the blade apparatus, a second pair of cams attached to the fixed end of said blade apparatus, wherein a first one of said second pair of cams is rotatably mounted with respect to a second one of said cams, said second pair of cams having protrusions between one another, wherein the first cam is selectively rotatable between a first open position and a second locked position in which the protrusions engage to apply increased pressure between the blades, and wherein the second cam of said second pair of cams is fixedly mounted to the blade apparatus, a connecting link attached at a distal end to the first cam of said first pair of cams, and attached at a proximal end to the first cam of said second pair of cams, wherein the connecting link is movable between a first open position in which both of said pairs of cams are in said open position and a second locked position in which both of said pairs of cams are in said locked position, a drive link pivotally mounted at a first end to the blade apparatus and pivotally mounted at an interior point to the connecting link, wherein the drive link is selectively movable between a first open position in which the switch is open, a second closed position in which the blade apparatus is caused to engage a receiving portion of the jaw terminal while the cams remain in said open position, and a third locked position in which the connecting link is caused to move to its said locked position, and a drive shaft pivotally mounted to a second end of said drive link, wherein rotation of said drive shaft facilitates movement of the drive link between its said first, second, and third positions, wherein the drive shaft has a free end which is fixed relative to the hinge terminal such that said rotation of the drive shaft forces the drive link to move between said positions forming a shaft link angle between the drive shaft and the drive link at a first angle less than 180° when the drive link is in said first position, a second angle greater than the first angle and less than 180° when the drive link is in said second position, and a third angle substantially equal to 180° when the drive link is in said third position, and wherein the drive shaft is spring loaded at a point of connection with the drive link, and wherein torsional force must be overcome in order to rotate the drive shaft in either direction.

13. The pressure switch device according to claim 12, wherein spacers are mounted along a shaft of said fasteners between said blades.

14. The pressure switch device according to claim 13, wherein spring washers are mounted on the shafts of said fasteners for providing further pressure between said blades.

15. The pressure switch device according to claim 14, wherein said fasteners are threaded bolts having a nut fastened to their free end.

16. The pressure switch device according to claim 12, wherein a fuse is mounted on either the jaw terminal or the hinge terminal.

17. A method of forming a pressure switch device comprising the steps of:

providing a hinge terminal having a fixed end of a blade apparatus pivotally attached thereto, providing a jaw terminal adapted to receive a free end of said blade apparatus at a receiving portion, said blade apparatus having a first blade and a second blade for straddling said hinge terminal and said jaw terminal, wherein said first blade and said second blade are fastened together via a first fastener at opposing free ends of said blades and via a second fastener at opposing fixed ends of said blades, providing a first pair of cams attached to the free end of said blade apparatus, wherein a first one of said first pair of cams is rotatably mounted with respect to a second one of said cams, said cams having protrusions between one another, wherein the first cam is selectively rotatable between a first open position and a second locked position in which the protrusions engage to apply increased pressure between the blades, and wherein the second cam is fixedly mounted to the blade apparatus, providing a second pair of cams attached to the fixed end of said blade apparatus, wherein a first one of said second pair of cams is rotatably mounted with respect to a second one of said cams, said second pair of cams having protrusions between one another, wherein the first cam is selectively rotatable between a first open position and a second locked position in which the protrusions engage to apply increased pressure between the blades, and wherein the second cam of said second pair of cams is fixedly mounted to the blade apparatus, providing a connecting link attached at a distal end to the first cam of said first pair of cams, and attached at a proximal end to the first cam of said second pair of cams, wherein the connecting link is movable between a first open position in which both of said pairs of cams are in said open position and a second locked position in which both of said pairs of cams are in said locked position, providing a drive link pivotally mounted at a first end to the blade apparatus and pivotally mounted at an interior point to the connecting link, wherein the drive link is selectively movable between a first open position in which the switch is open, a second closed position in which the blade apparatus is caused to engage a receiving portion of the jaw terminal while the cams remain in said open position, and a third locked position in which the connecting link is caused to move to its said locked position, and providing a drive shaft pivotally mounted to a second end of said drive link, wherein rotation of said drive shaft facilitates movement of the drive link between its said first, second, and third positions, wherein the drive shaft has a free end which is fixed relative to the hinge terminal such that said rotation of the drive shaft forces the drive link to move between said positions forming a shaft link angle between the drive shaft and the drive link at a first angle less than 180° when the drive link is in said first position, a second angle greater than the first angle and less than 180° when the drive link is in said second position, and a third angle substantially equal to 180° when the drive link is in said third position, and wherein the drive shaft is spring loaded at a point of connection with the drive link, and wherein torsional force must be overcome in order to rotate the drive shaft in either direction.

18. The method according to claim 17, further comprising the step of providing spacers mounted along a shaft of said fasteners between said blades.

19. The method according to claim 18, further comprising the step of providing spring washers mounted on the shafts of said fasteners for providing further pressure between said blades.

20. The method according to claim 17, further comprising the step of providing a fuse mounted on either the jaw terminal or the hinge terminal.

* * * * *